US006106144A

United States Patent [19]

Schön

[11] Patent Number: 6,106,144

[45] Date of Patent: Aug. 22, 2000

[54] PROCESS AND DEVICE FOR GRAVIMETRIC TEST GAS PRODUCTION BY MEANS OF REWEIGHING

[75] Inventor: Helmut Schön, Pfaffenhofen, Germany

[73] Assignee: Linde Technische Gase GmbH, Germany

[21] Appl. No.: 09/125,384

[22] PCT Filed: May 5, 1997

[86] PCT No.: PCT/EP97/02276

§ 371 Date: Aug. 18, 1998

§ 102(e) Date: Aug. 18, 1998

[87] PCT Pub. No.: WO97/42447

PCT Pub. Date: Nov. 13, 1997

[51] Int. Cl.[7] ..... B01F 15/02

[52] U.S. Cl. ..... 366/141

[58] Field of Search ..... 366/138, 141, 366/142, 151.1, 152.1, 152.2, 162.1, 341, 348, 349; 141/2, 4, 7, 83, 47–49, 100, 102, 197, 266, 279; 364/528.1, 528.4

[56] References Cited

U.S. PATENT DOCUMENTS

| | | | |
|---|---|---|---|
| 4,153,083 | 5/1979 | Imler et al. | 141/4 |
| 5,353,848 | 10/1994 | Gates et al. | 141/83 |
| 5,826,632 | 10/1998 | Micke et al. | 141/83 |
| 5,901,758 | 5/1999 | Hwang et al. | 141/197 |
| 5,913,344 | 6/1999 | Wronski et al. | 141/83 |

FOREIGN PATENT DOCUMENTS

| | | |
|---|---|---|
| 3739950 | 6/1989 | Germany . |
| 4225981 | 2/1994 | Germany . |

OTHER PUBLICATIONS

DE 3739950—English Abstract.
DE 4225981—English Abstract.

*Primary Examiner*—Charles E. Cooley
*Attorney, Agent, or Firm*—Millen, White, Zelane, & Branigan, P.C.

[57] ABSTRACT

A process for gravimetric production of test gas by re-weighing includes a series of sequential process steps, the first of which is weighing an evacuated gas container on a scale and then connecting a gas feed line to a control valve that is connected to the gas container by a controllable adjustment element connected to the scale. The controllable valve is automatically opened to fill a first test gas component, with the amount placed in the first test gas component being automatically monitored by weighing the gas container. After a selected quantity of test gas is provided, the controllable valve is closed. The connection between the gas feed line and controllable valve is accomplished by an adjustable fluid cylinder which automatically disconnects the gas feed line from the scale. The gas container is then reweighed and the process repeated for each subsequent test gas component placed in the gas container.

15 Claims, 1 Drawing Sheet

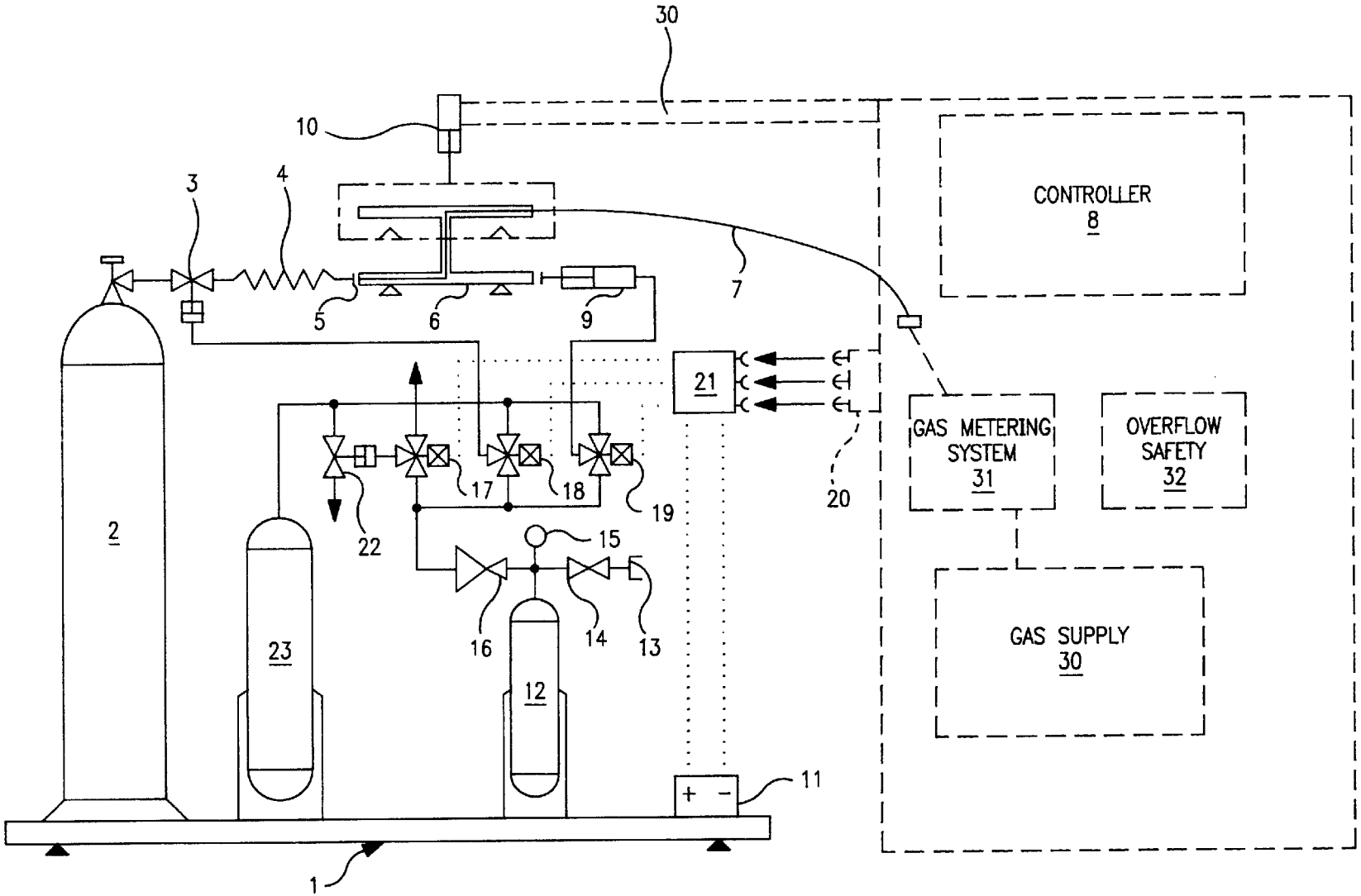
CONTROLLER
8
OVERFLOW SAFETY
32
GAS METERING SYSTEM
31
GAS SUPPLY
30
30
7
20
21
11
+
−
19
13
9
15
14
18
12
17
16
6
22
10
5
4
23
1
3
2

PROCESS AND DEVICE FOR GRAVIMETRIC TEST GAS PRODUCTION BY MEANS OF REWEIGHING

BACKGROUND OF THE INVENTION

Test gas is defined as an exactly mixed, precision gas mixture with a defined composition, i.e., a composition that is known in terms of the type and quantity of its components. In many cases it consists of a basic gas or basic gas mixture that contains the main component of the test gas and one or more admixtures, which are used directly for testing or calibration.

Test gases are needed with different admixtures, whose types, numbers, and concentrations vary widely. The range of applications for test gases extends from the calibration and adjustment of measurement devices, to process optimization and system monitoring, to research and development, to medicine.

Test gases are mainly produced by combining defined quantities of different gas fractions. The oldest production methods are manometric and volumetric in nature. The manometric process is based on the pressure change that occurs after the individual admixtures or the basic gas are added. Conversion with the aid of phenomenological gas state equations is required in order to precisely determine the mass concentrations. In the case of the volumetric process, the volumes of the individual gas mixture components are determined using, e.g., flowmeters and are transferred to a gas container, hereinafter referred to as a flask. With both processes, however, the precision of mixing is relatively low, so that additional gas analysis has to be carried out in order to precisely determine the gas composition.

With the availability of sufficiently accurate scales, the gravimetric production of test gases quickly became common and is now generally preferred. The principle is that the gas mixture components are put into the flask one after the other, and after each addition the increase in mass is determined by weighing. This provides the direct reference between the gases that are weighed in and the base values "kg" and "mol", and then it is no longer necessary to convert using state equations. Since mass determinations by means of weighing are among the most accurate of physical measuring processes, test gases of extremely high precision can be produced with this method.

In practice, the gravimetric production of test gases is done in such a way that an evacuated flask is placed on a scale, and the connection is made to the gas supply, gas metering, and control system by means of a gas feed line, generally a capillary with which any influence on the weighing process is kept to an absolute minimum. The subsequent procedure is distinguished depending on whether reweighing is done or not.

When production is done without reweighing, the gas feed line required for supplying gas is first connected to the flask, and a first weighing is carried out. Then the first component according to the calculated recipe of the test gas that is to be produced is put in. Usually, the components are put in in the sequence of rising concentration. Once the filling procedure has been completed, the flask with the attached gas feed line and the first component that it contains are weighed again. The difference between the two weighings of the flask before and after it is filled yields the mass of the first component that it contains. These steps are then suitably repeated for all subsequent test gas components.

When the weighings are done with the gas feed line attached, however, the test results are adulterated owing to the influence of the tension in the gas feed line on the scale. In general, therefore, the values that are determined in this way cannot be used to certify the composition. Rather, such certification is established by subsequent physical-chemical analysis against a test gas standard.

In order to correct this deficiency, use is made of the process of gravimetric test gas production with reweighing. In this case, before and after each component is put in, the gas feed line is detached from the flask, and a so-called reweighing is carried out. Since in each case the scale is completely detached from the gas supply, only the flask with the corresponding contents and without perturbing external influences is weighed. The values that are determined from reweighing can thus be used to determine exactly the masses of the individual components. With this process, the certification of composition is accomplished strictly by means of determination of mass. Final gas-analysis tests are therefore no longer needed.

Up until now, gravimetric test-gas production with reweighing has been done manually and is therefore very labor-intensive and time-intensive. It has not yet been possible to automate the process.

From DE-C-37 39 950 a process is known for automatically decanting gases into flasks after their weights are taken. To do this, a rotary head for opening and closing the flask valve and a fill head for putting in the gas are set up. When the flask is filled with gas, gas is put into the flask in several steps and then weighed until the specified end weight is reached. The above-described decanting method is not, however, suitable for the production of precision gas mixtures since a gas hose, a compressed-air hose, and a power cable extend out from the scale and affect the weighing process.

SUMMARY OF THE INVENTION

The object of this invention is therefore to provide a process with which the gravimetric production of test gases with reweighing can be automated. Another object of the invention is also to provide a device for implementing this process.

The process according to the invention makes it possible to automatically produce the test gas according to the gravimetric procedure with reweighing. A controllable valve is connected to the manually activated flask valve, in most cases a valve equipped with a handwheel; this makes it possible to automatically open and close the flask in a controlled manner without using the handwheel. The gas feed line is connected to the flask by a controllable adjustment element, which is connected to the scale.

During the production of test gases, the flask is first evacuated, and then the controllable valve is closed. However, the flask valve can remain open during the entire production process. After the evacuated flask is weighed for the first time, the connection between the gas feed line and flask is sealed gas-tight, and thus the connection between the gas feed line and the scale is established. After the controllable valve is opened, the first component of the test gas is put in. The amount that is put in is automatically monitored by weighing the flask and, after the required amount is reached, the gas supply is turned off and the valve is closed. The precision of the test gas component mass that is determined in this way and the extent to which it deviates from the specified value determine the preparatory precision of the process. Reweighing is done in order to certify the gas composition. To accomplish this, according to the invention the seal between the gas feed line and the valve is broken by means of the adjustment element, the gas feed line is disconnected from the scale, and reweighing is then done. These process steps are repeated until all of the components of the test gas have been put in and reweighed according to specification.

It is advantageous for the controllable valve to be connected directly to the flask. It is also possible, however, to interpose other elements that allow gas to flow, for example, lines, or measurement devices, such as manometers or flowmeters, between the valve and flask. The only thing that is essential is that the flask be sealed gas-tight with respect to its environs when the valve is closed.

Likewise, other elements that allow the gas to flow can be interposed between the gas feed line and the controllable valve. The only thing that is important is that the connection be reversible, i.e., that it can be broken, and that when the connection is in place that there be a gas-tight seal with respect to the environs.

Suitably, the reversible connection between the gas feed line and the controllable valve is opened or closed by an automatic lifting or pulling cylinder. For example, it is possible to compress the gas feed line by means of a pneumatically or electrically activated cylinder to close the connection to the sealed valve and then to retract the cylinder in order to open it.

The gas feed line may also be compressed against the seal by means of other suitable means, e.g., a cam or an articulated lever. It is also possible to guide the gas feed line with the aid of other means, e.g., a belt that can be moved linearly and is equipped with a holding device for the gas feed line, in such a way that connection between the gas feed line and the controllable valve is opened or closed.

The gas feed line is preferably made flexible, so that it can be used to connect the flask to the corresponding counterpart and to be moved some distance from it when it is detached therefrom. Moreover, however, it is suitable to design the gas feed line in such a way that, when it is connected to the scale, it does not exert any additional weight on the scale. For this purpose, a flexible but self-supporting design of the gas feed line e.g., as a thin tube, has been found to be suitable. It is also possible to compensate for the weight of the gas line, for example, by using a bypass and a counterweight. In addition, it is also possible to calculate out of the weighing results the weight of the gas feed line by the control unit.

To ensure exact reweighing, the gas feed line must be detached both from the flask and from the scale. In the case where the gas feed line is designed to be self-supporting or where there is a device for compensating for the weight of the gas feed line, it is advantageous to combine the detachment of the connection between the gas feed line and the flask with the simultaneous disconnecting of the gas feed line from the scale.

It is also advantageous to detach the gas feed line from, and attach it to, a controllable lifting or pulling cylinder of the scale that is not connected to the scale. In this case, the weight of the gas feed line is supported by this cylinder when the line is detached from the scale.

When the flask is reweighed, all connections between the scale and its environs must be detached in order to ensure precise weighing. In addition to the gas feed line, this particularly includes the power supply and the control of the controllable valve and the controllable adjustment element. It is therefore advantageous if an autonomous power supply that is located on the scale provides power for activating the controllable valve and the adjustment element. This eliminates the need for supply lines that are otherwise required and that can influence the reweighing. For example, the scale can have an electric battery that supplies the required power for all valves and devices that are to be used.

Depending on the design of the elements that are to be controlled, in addition to the electrical power storage unit there can be other power storage units or combinations of different power storage units. It is advantageous, for example, for the regulation and control of all elements that are to be activated to be done electrically, while the actual activation process is done by pneumatic means. In this case, accordingly, in addition to an electrical battery there is also a pneumatic power storage unit, for example, a gas cylinder that is under an overpressure.

An autonomous power supply for all elements that are to be activated and are located on the scale, for example, the controllable valve, the adjustment element, or other adjustable valve and devices, is not absolutely necessary, however. It is also possible to supply the power required to activate the elements from the outside, upon demand. For example, such electrically adjustable elements can be designed to be self-supporting so that, after the electric power supply is disconnected, they remain in the state in which they are set. Thus it is possible to detach the electric supply lines from the scale after the elements to be controlled have been appropriately activated. Any negative influencing of the weighing process, especially during reweighing, is thus avoided. Such power supply lines can be connected to the devices located on the scale with the aid of, e.g., so-called knife contacts.

To control the production of test gas overall, there is a control unit whose function is to ensure all necessary controls during the production of test gases according to a specified recipe and to coordinate these controls with one another. This includes the opening and closing of the valve located between the gas supply line and the flask and of the valves of the gas supply unit that is generally located next to the scale, as well as the controlling of the adjustment element. In addition, the control unit monitors and appropriately adjusts the pressure conditions in the gas supply lines and, in the case of pneumatic control, also the pressure conditions in the control lines, as well as all weighing processes. Numerous other monitoring and adjustment functions, as well as the computer processing of the weighing results, can also be picked up, preferably by the control unit so that a completely automatic operating sequence is achieved.

The entire control unit may be located both on the scale and next to it. In addition, it is also possible to put only certain parts of the control unit on the scale.

It is advantageous not to put the control unit on the scale. Since the control unit must control both elements on the scale and others next to it, regardless of where the control unit is located a device is needed to transmit the control signals to and from the scale. Putting the control unit next to the scale has the advantage that the entire weight that the scale has to support is smaller; this means that a scale with higher measurement precision can be selected. In addition, if necessary, this kind of arrangement allows manual intervention in the automatic production process without the weighing being influenced thereby.

The transmission of signals between the control unit located next to the scale and the elements to be controlled that are located on the scale or between the control unit located on the scale and units to be controlled that are not located on the scale is preferably done by contactless means in order to keep from influencing the weighing. For this purpose, optical transmission using so-called optocouplers is suitable. The light transmitters can be light-emitting diodes (LED), which emit infrared or visible light in most cases. The light receivers can be photodiodes, phototransistors or Darlington photo transistors.

In order to keep atmospheric air and, especially, moisture from penetrating into the gas feed line, it has been found to be advantageous to flush the gas feed line with an inert gas in the state where it is detached from the flask. Preferably, after the gas feed line is detached from the controllable valve, said line is moved away from the counterpart with which it is to hook up only to the extent that, on the one hand, the gas feed line is completely detached from the scale but, on the other hand, the counterpart is also covered by the inert gas stream directed through the gas feed line. This also keeps air from penetrating into the gas area up to the controllable valve.

In addition to the process for gravimetric test gas production with reweighing, the invention also pertains to a device for implementing this process with the scale for weighing the gas container with its contents and to a gas feed line for supplying the test gas components.

According to the invention, a scale for weighing a gas container with and without contents, a gas feed line for putting the test gas components into the gas container, a controllable valve that is connected to the gas container, and a connection that is located between the gas feed line and the controllable valve and that can be connected to and detached from a controllable adjustment element that is connected to the scale are provided.

Suitably, the adjustment element connected to the scale is designed as a controllable lifting or pulling cylinder.

It is advantageous for there to be an autonomous power supply located on the scale. To supply electric power, it is suitable to use an electric battery, and to supply pneumatic energy it is suitable to use a compressed-gas container.

When pneumatic control is used for the elements that are to be controlled, it is important that no control gas escape in order to avoid adulterating the weighing. In this case, it is therefore advantageous to put a low-pressure gas container on the scale that will intercept control gases that are released from elements located on the scale, e.g., valves.

The proposal according to the invention has numerous advantages over the state of the art. Owing to the comprehensive automation of the gravimetric test gas production process, the number of operating personal can be rationally reduced. The process of producing test gases is also speeded up, so that with less labor input considerably more flasks can be filled. Gravimetric production with reweighing makes it possible to eliminate final gas-analysis tests to certify the composition. Finally, random gas-analysis testing is used on an occasional basis, just to ensure that the process is operating properly.

Up until now, the compositions of the test gases had to be determined after fabrication by conducting a physical-chemical analysis of them against a test gas standard. Such test gas standards are generally produced by gravimetric production by means of reweighing. In the previous purification process, the precision of the test gas composition was therefore determined by the accuracy of the analysis and that of the standard. With the process of the invention, the precision of the composition is determined by the reweighing. The test gases that are produced therefore correspond qualitatively to the previously produced test gas standards. Thus, in addition to its quantitative advantages, the proposed procedure also has qualitative advantages over previously known processes.

Below, the proposal according to the invention will be explained in greater detail with the aid of the schematic drawing.

BRIEF DESCRIPTION OF THE DRAWINGS

The single FIGURE shows a device according to the invention for the gravimetric production of test gases.

DETAILED DESCRIPTION

On scale 1 is a flask 2 that is to be filled and that is connected on the gas path via controllable, pneumatically activated valve 3, flexible line 4, and coupling 5 to movable connector 6. A capillary 7, which allows minimal influencing of the weighing process and through whose other end the filling gases are fed in, is connected to connector 6. Next to the scale, indicated only in dashed lines in the drawing, are the gas supply 30, a gas metering system 31, an overflow safety 32, and a PC-supported control 8.

Connector 6 is connected to flask 2 that is to be filled in a way that is consistent with the filling pressure by virtue of the fact that pneumatically activated lifting cylinder 9 closes coupling 5. Coupling 5 consists of a chambered O-ring, which is pushed against a counterpart. The contact between connector 6 and scale 1, which is proportional to mass, is eliminated by virtue of the fact that when coupling 5 is opened, connector 6 is lifted a few millimeters by pulling cylinder 10, which is not connected to the scale. Capillary 7 is designed as a thin metal tube so that it can be connected to and disconnected from line 4. Moreover, however, capillary 7 is also designed to be self-supporting so that, when coupling 5 is closed, it does not exert any additional pressure on scale 1. By contrast, with capillary 7 attached, it is impossible to keep the weighing from being influenced by stresses that arise in capillary 7.

On scale 1 there is also an autonomous power supply, which is formed by electric battery 11 and a high-pressure gas cylinder 12. High-pressure gases cylinder 12 is filled with a suitable gas, e.g., nitrogen or compressed air, via coupling 13 and check valve 14. The pressure in high-pressure gases cylinder 12 can be monitored with the aid of manometer 15. The working pressure for valves 3 and 22, as well as for lifting and pulling cylinders 9 and 10, is adjusted with a pressure reducer 16. Control valves 17, 18, and 19 are designed as electrically activated 2-way valves. The control signals to control these valves are transmitted optically from signal transmitter 20 to switching amplifier 21, which switches valves 17, 18, and 19 according to program. As light transmitters, signal transmitter 20 has various light-emitting diodes that give off infrared and visible light. Photodiodes are integrated in switching amplifier 21 as light receivers. Switch amplifier 21 is electrically connected to battery 11. Low-pressure container 23 intercepts the pressure-relieved control air from valves 18 and 19 and thus keeps the weight on scale 1 from being reduced. At a time that is favorable for weighing, the pressure-relieved control air is deliberately vented to the atmosphere via valve 22. Valves 3 and 22 are designed in such a way that there are closed in the state where they are not under pressure. Lifting cylinder 9 is relieved from tension when not under pressure.

Below, the process according to the invention will be explained in greater detail using the production of a binary test gas mixture as an example.

Evacuated flask 2 that is to be filled is connected to valve 3, coupling 5 is closed by means of lifting cylinder 9, and valve 3 is opened. The gas path from capillary 7 to flask valve 3 is evacuated and thus checked for leaks. Then flask valve 3 is opened.

All subsequent process steps proceed under automatic control, without requiring any manual intervention. Valve 3 is closed, in which case control air is vented into the atmosphere via valve 22 in order to equalize pressure. Then capillary 7, flexible line 4, and connector 6 are brought to atmospheric pressure or a slight overpressure with the aid of inert gas. Coupling 5 is attached, and connector 6 is lifted by cylinder 10 and thus detached from scale 1. To keep atmospheric air and, in particular, moisture from getting inside, connector 6 is continuously flushed with inert gas via capillary 7. Owing to the slight parallel shifting of connector 6 by only a few millimeters, the scale-side part of coupling 5 is covered with inert gas. The first weighing is done in this state.

Coupling 5 is closed with the aid of cylinder 9. In addition, valve 22 is closed in order to keep control air from escaping. The gas path from gas feed line 6, 7 to flexible line 4, to valve 3 is evacuated via capillary 7. Valve 3 is opened, and a second weighing is carried out, now with the gas feed line connected. According to the recipe, the corresponding quantity of the first component of the test gas is put in. After the desired quantity has been put in, valve 3 is closed, in which case the control air is intercepted in low-pressure container 23. Capillary 7, connector 6, and line 4 are relieved of pressure and evacuated. Weighing is then done in order to check the quantity that has been put in. If the filling weight has not yet been reached, then via gas feed line 6, 7 the first test gas component is fed in once again, valve 3 is opened, and the missing quantity is put in. Then valve 3 is again closed, gas path 4, 6, 7 is relieved of pressure and evacuated, and control weighing is done. If the specified end weight has been reached, gas feed line 6, 7 and line 4 to valve 3 are flooded with inert gas, and coupling 5 is opened. The control air is again intercepted in container 23. From the reweighing that follows, the quantity of the first component that is put in can be precisely determined. Because of the stresses in capillary 7, the difference between the two weighings without capillary 7 connected is different from the difference between the weighings with capillary 7 connected. Only the former is suitable for certifying the mass of the component that is filled in. The control air is again blown off via valve 22. Another weighing provides a lower result and thus confirms that the mass of the control air may not be ignored.

Coupling 5 is closed, and after gas path 4, 6, 7 is evacuated, weighing is repeated. The filling of the second component is done in a way that is similar to the process described when the first component was put in. The final reweighing yields the precise mass of the second component that is put in.

What is claimed is:

1. A process for gravimetric production of test gas by means of reweighing, comprising the following sequential steps:

a. weighing an evacuated gas container (2) on a scale (1);

b. connecting a gas feed line (7) to a controllable valve (3) that is connected to the gas container (2) by means of a controllable adjustment element (9) that is connected to the scale (1);

c. automatically opening the controllable valve (3);

d. filling a first test gas component in the gas container with an amount automatically monitored by weighing the gas container (2) and, after a required amount of that gas is reached, closing the controllable valve (3);

e. detaching the connection between gas feed line (7) and the controllable valve (3) by means of the adjustment element (9) and automatically detaching the gas feed line (7) from the scale (1);

f. reweighing the gas container (2);

g. repeating steps b. to f. for each subsequent test gas component put into the gas container (2).

2. A process according to claim 1, wherein the connection between the gas feed line (7) and the controllable valve (3) is opened and closed by the adjustment element and wherein the adjustment element is an automatically activated lifting or pulling cylinder (9).

3. A process according to claim 1, whereby the gas feed line (7) is connected to and separated from the scale (1) by a controllable lifting or pulling cylinder (10) that is not connected to the scale (1).

4. A process according to claim 1, whereby at least one autonomous power supply is located on the scale (1) and supplies the power to activate the valve (3) and the adjustment element (9).

5. A process according to claim 1, whereby a control unit (8) which is not located on the scale (1), ensures the control of the valve (3) and the adjustment element (9).

6. A process according to claim 1, whereby signals are transmitted from a control unit (8) to the scale (1) without mechanical contact between the control unit (8) and the scale (1).

7. A process according to claim 1, whereby gas feed line (7) is flushed with an inert gas when the gas feed line (7) is separated from the gas container (2).

8. A device for gravimetric production of a test gas by reweighing with a scale (1) for weighing a gas container (2) with and without contents, the device comprising:

a gas feed line (7) to convey the test gas components into the gas container (2), a controllable valve (3) connected to the gas container (2), and a connection between the gas feed line (7) and controllable valve (3) that is opened and closed by a controllable adjustment element (9) connected to the scale (1).

9. The device according to claim 8 wherein the controllable adjustment element (9) is configured as a lifting or pulling cylinder to open and close the connection between the gas feed line (7) and the valve (3).

10. The device according to claim 8 including a controllable lifting or pulling cylinder (10) not mechanically connected to the scale (1) for disconnecting the gas feed line (7) from the scale (1).

11. The device according to claim 8 including an autonomous power supply located on the scale (1).

12. The device according to claim 11 wherein the power supply is an electric battery (11) located on the scale (1).

13. The device according to claim 11 including a compressed gas container (12) located on the scale (1).

14. The device according to claim 11 including a low-pressure container (23) that is located on the scale (1).

15. The device according to claim 8 including a control unit (8) which is not located on scale (1) which controls the valve (3) and the controllable adjustment element (9).

* * * * *